US008641147B2

(12) United States Patent
Diller

(10) Patent No.: US 8,641,147 B2
(45) Date of Patent: Feb. 4, 2014

(54) PROCEDURE CHAIR WITH INTERCHANGEABLE HEADRESTS

(75) Inventor: Mark G. Diller, Clayton, OH (US)

(73) Assignee: Midmark Corporation, Versailles, OH (US)

( * ) Notice: Subject to any disclaimer, the term of this patent is extended or adjusted under 35 U.S.C. 154(b) by 1518 days.

(21) Appl. No.: 11/771,423

(22) Filed: Jun. 29, 2007

(65) Prior Publication Data

US 2009/0001799 A1 Jan. 1, 2009

(51) Int. Cl.
*A47C 7/38* (2006.01)

(52) U.S. Cl.
USPC ..... 297/391; 297/400

(58) Field of Classification Search
USPC ..... 297/391, 400, 402, 408, 410; 5/622
See application file for complete search history.

(56) References Cited

U.S. PATENT DOCUMENTS

| | | | | | |
|---|---|---|---|---|---|
| 408,823 | A * | 8/1889 | Carrick | 297/405 |
| 1,531,170 | A * | 3/1925 | Berninghaus | 297/410 |
| 1,885,507 | A * | 11/1932 | Browne | 297/409 |
| 2,740,467 | A * | 4/1956 | Page | 297/409 |
| 3,317,244 | A * | 5/1967 | Ferro | 297/410 |
| 3,563,603 | A * | 2/1971 | D'Aprile et al. | 297/410 |
| 3,572,835 | A * | 3/1971 | Kees et al. | 297/410 |
| 3,761,128 | A * | 9/1973 | Schenk et al. | 297/408 |
| 3,877,751 | A * | 4/1975 | Rasmussen | 297/410 |
| 3,885,831 | A * | 5/1975 | Rasmussen | 297/410 |
| 4,111,483 | A * | 9/1978 | Jaeger | 297/410 |
| 4,335,920 | A * | 6/1982 | Hirth | 297/408 |
| 4,387,888 | A | 6/1983 | Marinakis | |
| 4,620,697 | A | 11/1986 | Pithon | |
| 4,762,367 | A * | 8/1988 | Denton | 297/409 |
| 4,856,848 | A * | 8/1989 | O'Sullivan et al. | 297/391 |
| 5,054,856 | A * | 10/1991 | Wang | 297/408 |
| 5,131,720 | A * | 7/1992 | Nemoto | 297/410 |
| 5,177,823 | A * | 1/1993 | Riach | 5/636 |
| 5,316,372 | A * | 5/1994 | Amner | 297/408 |
| 5,328,244 | A * | 7/1994 | Ishihara et al. | 297/391 |
| 5,348,376 | A * | 9/1994 | Natori | 297/391 |
| 5,356,202 | A * | 10/1994 | Itoh | 297/391 |
| 5,362,129 | A * | 11/1994 | Itoh et al. | 297/391 |
| 5,390,982 | A * | 2/1995 | Johnson et al. | 297/410 |
| 5,427,436 | A | 6/1995 | Lloyd | |
| 5,690,387 | A * | 11/1997 | Sarti | 297/397 |
| 5,722,732 | A * | 3/1998 | Haldenwanger | 297/483 |
| 5,733,010 | A * | 3/1998 | Lewis et al. | 297/411.32 |
| 5,964,505 | A * | 10/1999 | Koenig et al. | 297/408 |
| 6,151,734 | A | 11/2000 | Lawrie | |
| 6,183,045 | B1 * | 2/2001 | Marfilius et al. | 297/391 |
| 6,276,012 | B2 | 8/2001 | Borders | |
| 6,397,414 | B1 | 6/2002 | Lloyd | |
| 6,533,359 | B1 * | 3/2003 | Holstensson | 297/391 |
| 6,578,215 | B1 | 6/2003 | Heimbrock et al. | |
| 6,612,653 | B2 * | 9/2003 | Takata | 297/408 |
| 6,626,494 | B2 * | 9/2003 | Yoo | 297/296 |
| 6,718,580 | B2 | 4/2004 | Heimbrock et al. | |
| 6,754,923 | B2 | 6/2004 | Borders et al. | |
| 6,811,223 | B2 * | 11/2004 | Ito | 297/408 |
| 6,857,704 | B2 * | 2/2005 | Stenzel et al. | 297/408 |
| 6,893,096 | B2 * | 5/2005 | Bonn et al. | 297/409 |

(Continued)

*Primary Examiner* — David R Dunn
(74) *Attorney, Agent, or Firm* — Wood, Herron & Evans, LLP

(57) ABSTRACT

A patient procedures chair is provided with a system that permits ready interchangeability of patient headrests with ease of positioning and locking in position while at the same time guarding against inadvertent axial removal.

5 Claims, 7 Drawing Sheets

(56) References Cited

U.S. PATENT DOCUMENTS 6,928,676 B1 8/2005 Schwaegerle
7,144,083 B2 * 12/2006 List et al. ..... 297/391
2003/0115674 A1 6/2003 Heimbrock et al.
2007/0085401 A1 * 4/2007 Hunziker et al. ..... 297/410
2008/0007105 A1 * 1/2008 Viger ..... 297/408

* cited by examiner

PROCEDURE CHAIR WITH INTERCHANGEABLE HEADRESTS

BACKGROUND OF THE INVENTION

Patient comfort and positioning are important goals of all medical procedure chairs. Additionally, particular medical specialties have requirements beyond these basic considerations. For example, dermatologists, plastic surgeons, oral maxillofacial surgeons and specialists practicing otolaryngology require maximum access to the head and neck area of patients. Other medical specialists, such as gynecologists, proctologists and podiatrists have different desired features in procedure chairs. Thus, for procedures involving the head and neck area of patients, it is preferable that the position of the headrest be adjustable and that the neck area be narrow. The specific configuration of the headrest itself should be variable to accommodate different types of procedures involving the head. It is desirable, therefore, that the headrest, on the one hand, be easily positionable and readily locked in a desired position, and on the other hand, that headrests of different sizes and shapes can be quickly and easily substituted to enhance the performance of different types of procedures.

SUMMARY OF THE INVENTION

A procedure chair in accordance with the present invention is ideally adapted for those procedures specifically directed to the head and neck areas of the patient. A narrow neck section permits easy adjustment of the headrest toward and away from the back section of the chair and the headrest itself is adjustable about multiple axes for convenience in positioning the patient in an optimal position. More importantly, the entire headrest may be quickly and easily removed and a headrest of a different configuration or size substituted and locked securely in place without the use of tools. A single, hand-operated knob permits the headrests to be interchanged and locked into position; thus providing a rigid interconnection between the headrest and back section of the chair. The hand-operated knob serves the dual function of providing easy substitution of headrests and also of simultaneously locking the headrest about its multiple axes of adjustability, all with a simple twist of the hand-operated knob. To prevent inadvertent axial removal of a headrest during its adjustment about its axes, the headrest is provided with a recess in its lower surface that receives the headrest connector.

DESCRIPTION OF THE PREFERRED EMBODIMENT

Figure 1:
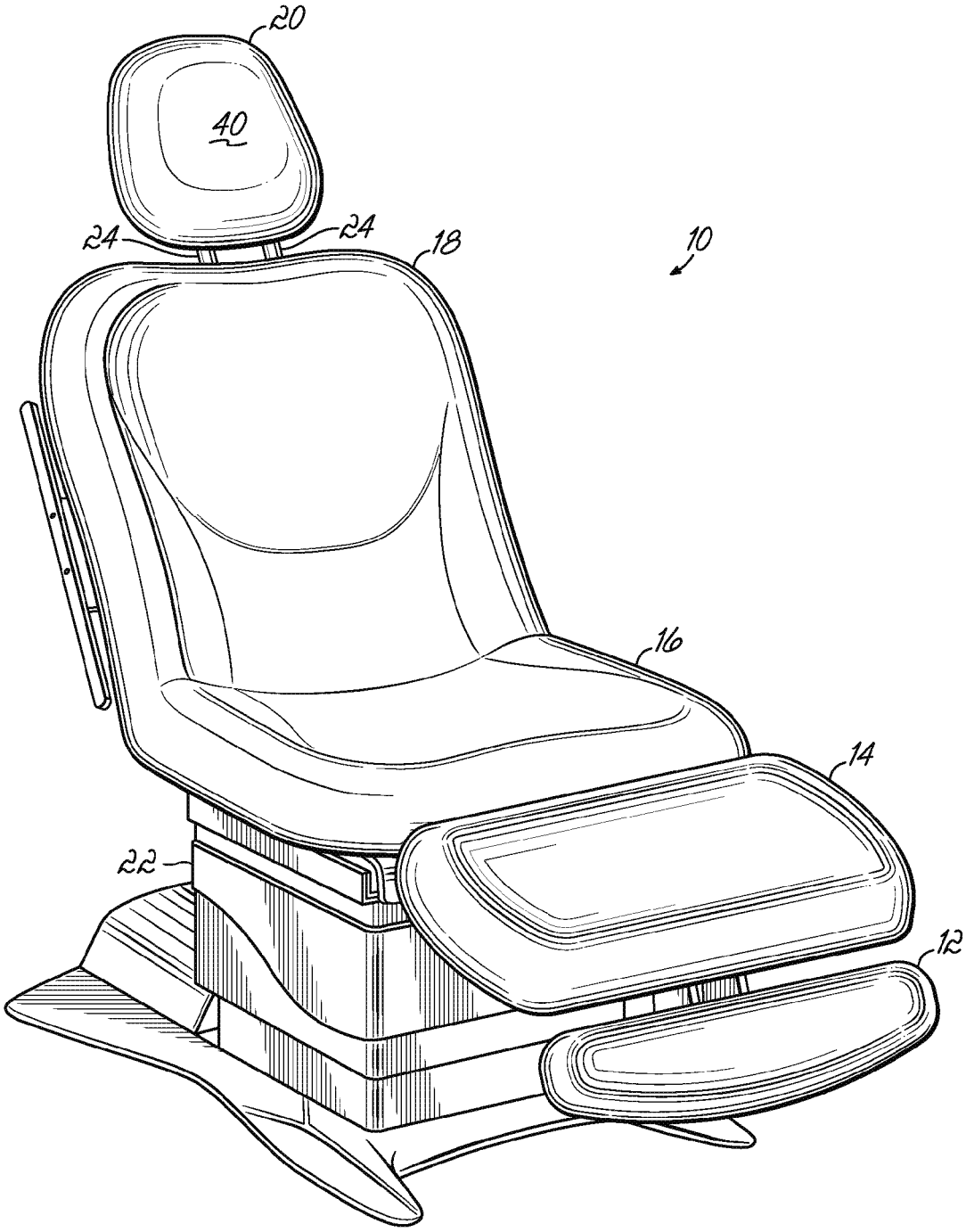
FIG. 1 is a perspective view of a procedure chair in accordance with the present invention.
Figure 2:
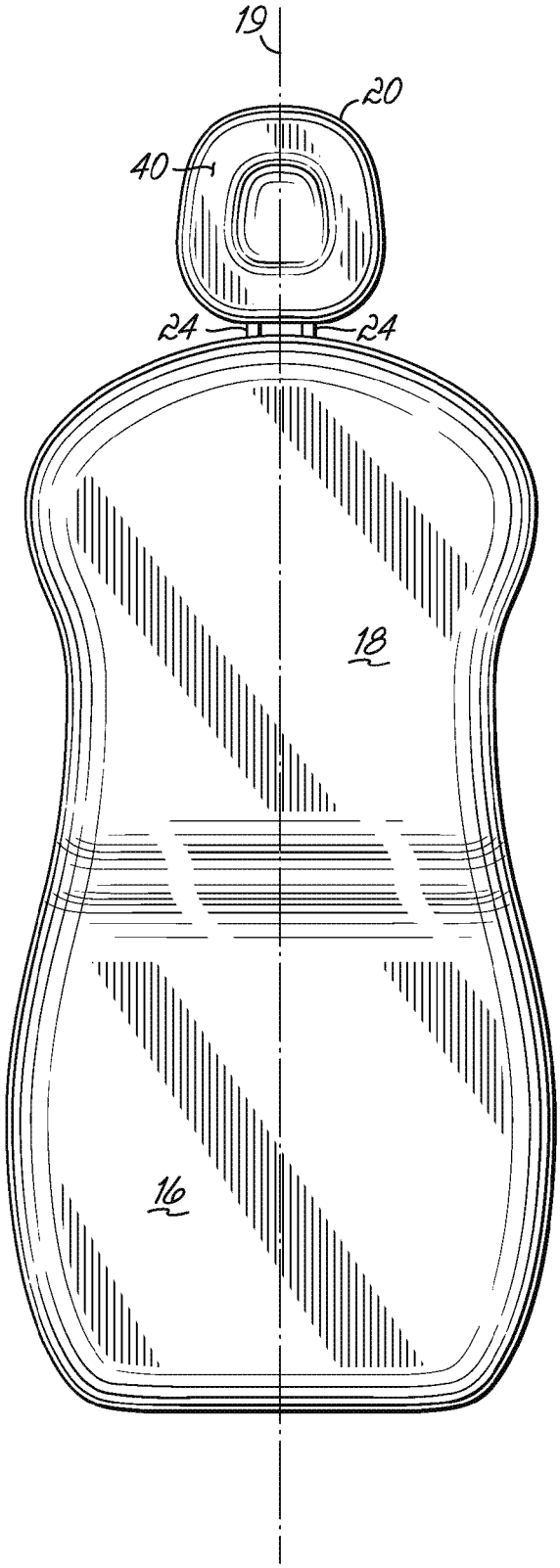
FIG. 2 is a plan view of the seat back and headrest of the chair extended out in planar configuration.
Figure 3:
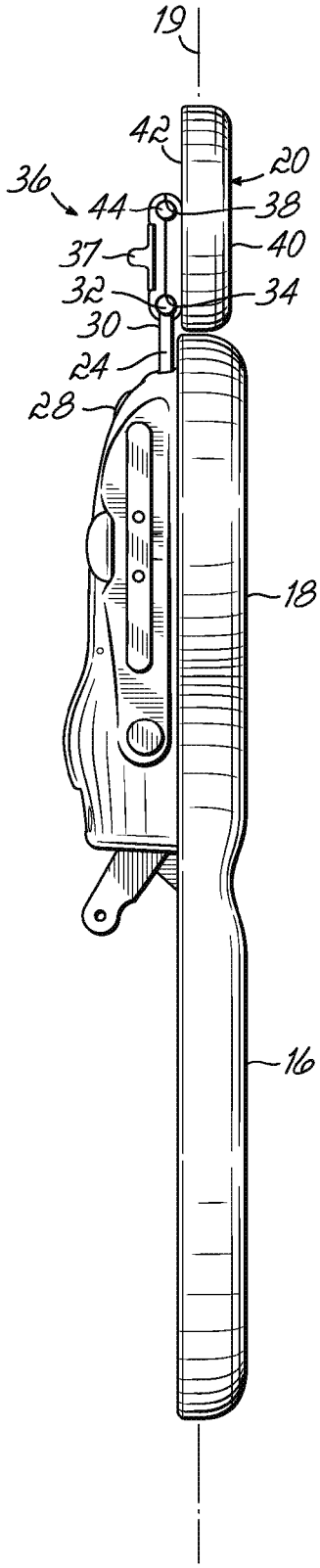
FIG. 3 is a side view of that portion of the chair shown in FIG. 2.
Figure 4:
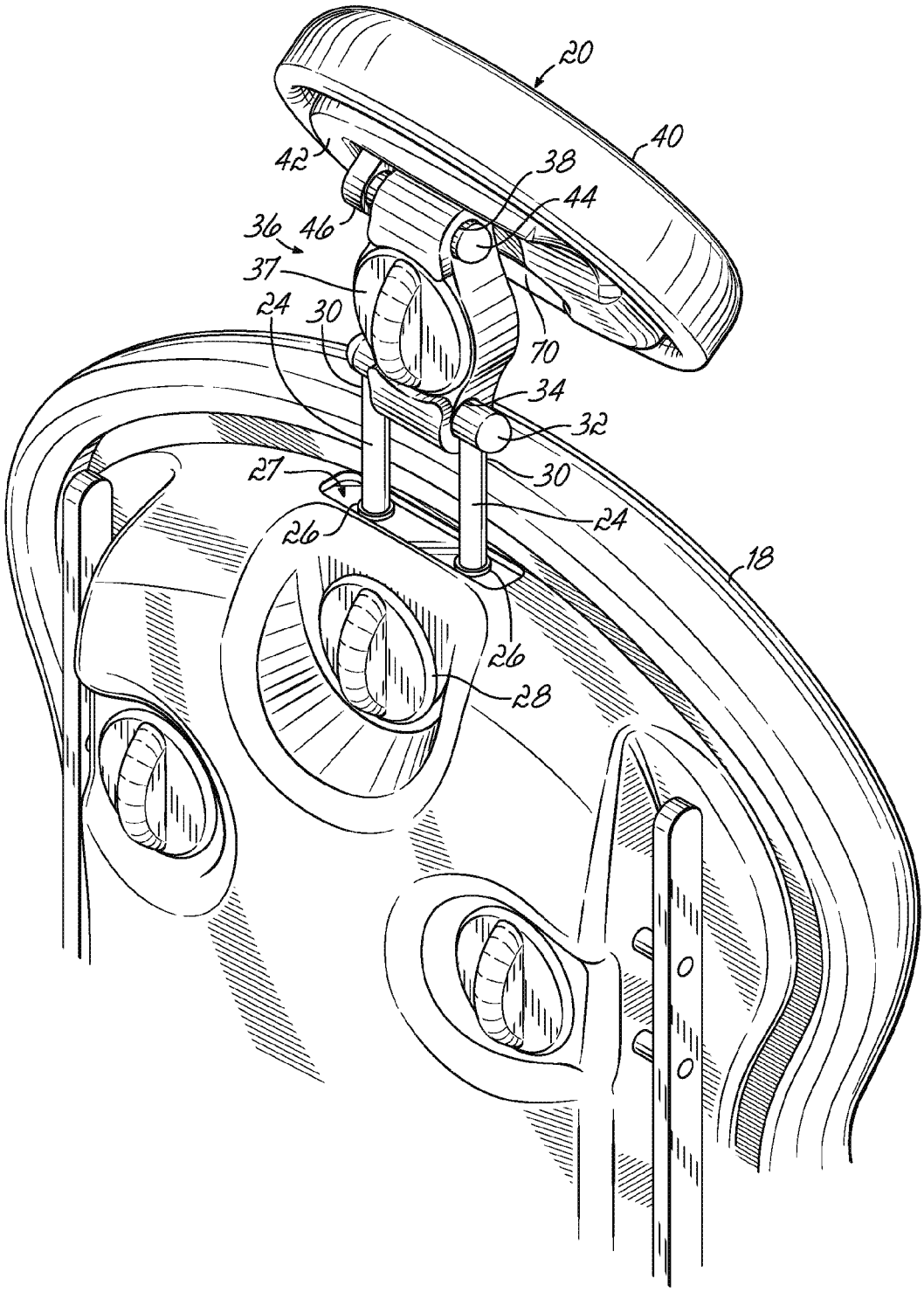
FIG. 4 is a perspective view of the upper portion of the back section and headrest of the chair.
Figure 5:
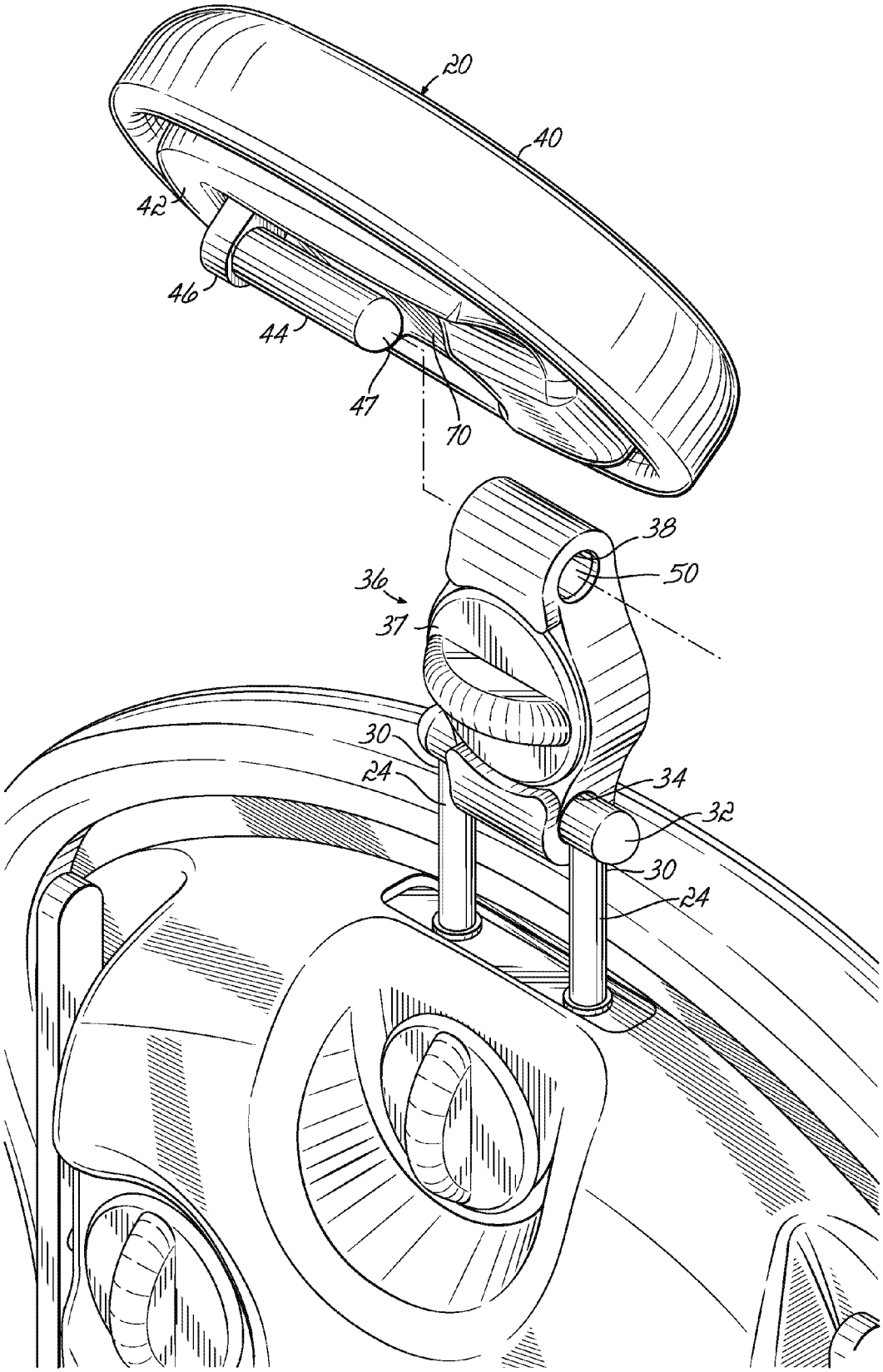
FIG. 5 is a perspective view illustrating the manner of removing the headrest.

FIG. 1 of the drawings shows a procedure chair 10 having a foot section 12, a leg section 14, a seat section 16, a back section 18, and a headrest 20. The chair is mounted on a base 22, which is capable of vertical movement to position a patient at an appropriate elevation. As best seen in FIGS. 4 through 5 of the drawings, a pair of posts 24 are slidably received in bearings 26 mounted in the back section 18. A clamping mechanism 27 is operable through a hand knob 28 to fix the posts 24 at their desired position with respect to the back of the chair 18. Fixed to the distal ends 30 of the posts 24 is a crossbar 32. The crossbar 32 is received in a socket 34 in one end of a connector 36 that is provided with a second parallel socket 38.

The headrest 20 has a padded upper surface 40 and a lower surface 42. A pintle 44 is fixed at one end 46 to the lower surface 42 of the headrest 20 and is cantilevered out over the lower surface 42. This cantilevered construction provides a free end 47, as best seen in FIG. 5, which is insertable into the socket 38 to permit selective attachment of headrests of various configurations. These may be as shown in FIGS. 7A-7C and 8A and B. Each, it will be noted, includes a cantilevered pintle 44' and 44" having free ends 47' and 47" to be received in the socket 38 of the connector 36. Also, it will be apparent that these are just a few of the wide variety of headrests of various sizes and shapes that are available.

The connector 36 engages both the crossbar 32 and pintle 44 in its sockets 34 and 38, respectively. Twisting the knob 37 clamps the crossbar 32 and the pintle 44 simultaneously, to lock the headrest against movement about the two parallel axes defined by the crossbar 32 and the pintle 44 and form a rigid connection between the headrest and back section, with no play or "slop." Thus, the headrest is both easily removed and replaced and easily adjusted about dual axes.

Figure 6:
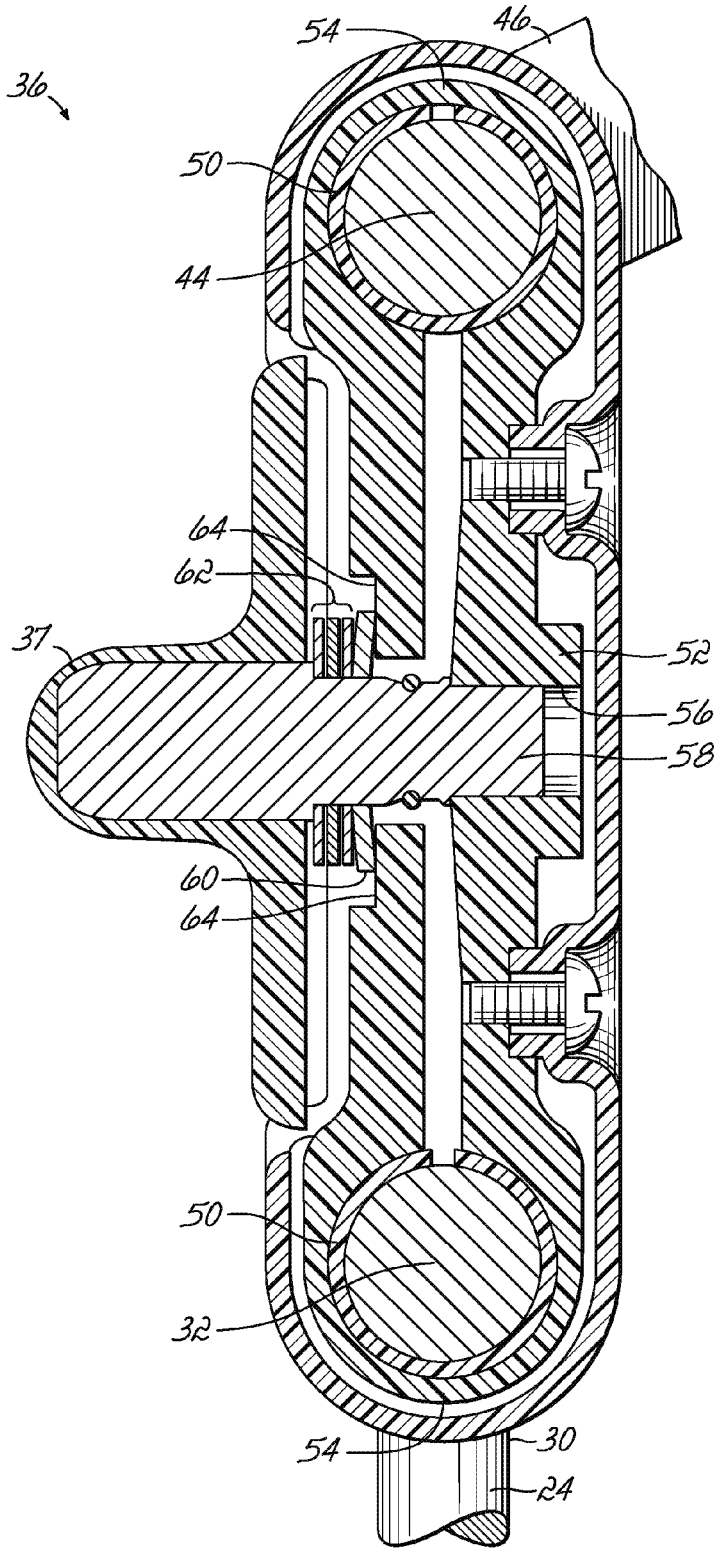
FIG. 6 is a cross-sectional view of the clamping mechanism associated with the headrest of the chair.

The clamping mechanism for the crossbar and pintle 32 and 48, respectively, is best seen in FIG. 6. The crossbar 32, pintle 44 and associated bearings 50 are received in a resilient clamp 52 having opposing, substantially C-shaped sections 54. The clamp 52 has a threaded central socket 56, which receives a threaded shaft 58, to which is attached the knob 37, as also seen in FIGS. 4 and 5 of the drawings.

A spring washer 60 and suitable bearing assembly 62 are interposed to bear on the upper leaf sections 64 of clamp 52 as the threaded shaft 58 is turned by the knob 37, causing the clamp to squeeze the bearings 50 and the pintle 44 and crossbar 32 received in the bearings and rigidly lock them in a desired position.

The same mechanism that permits the headrest 20 to be easily removed and replaced by another headrest also allows for adjustments of the position of the headrests about dual axes. As seen in FIG. 5 of the drawings, upon turning the knob 37 the clamping force exerted against the crossbar 32 and the pintle 44 is relieved. The headrest may then be adjusted as desired. The clamp is once again tightened to lock the headrest rigidly to the back section.

Figure 7A:
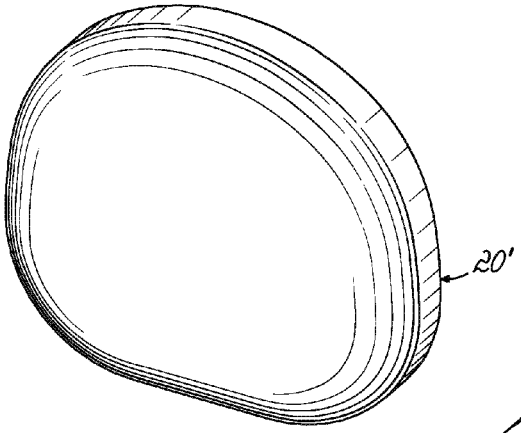
FIG. 7A is a front perspective view of a headrest of a different size and shape than that shown in FIGS. 1-4.
Figure 7B:
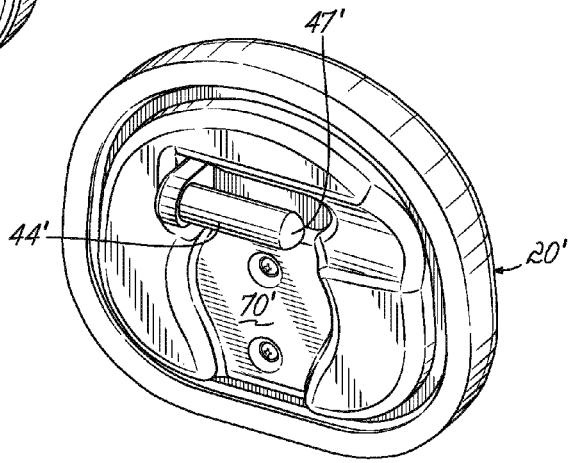
FIG. 7B is a rear perspective view of the headrest of FIG. 7A.
Figure 7C:
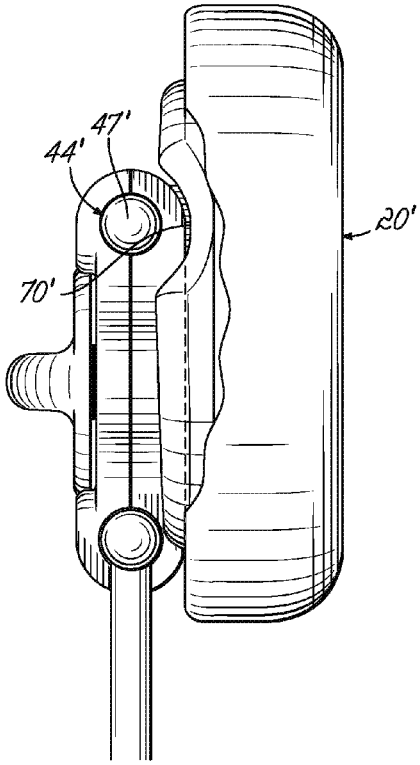
FIG. 7C is a side view of the headrest of FIGS. 7A and 7B.
Figure 8A:
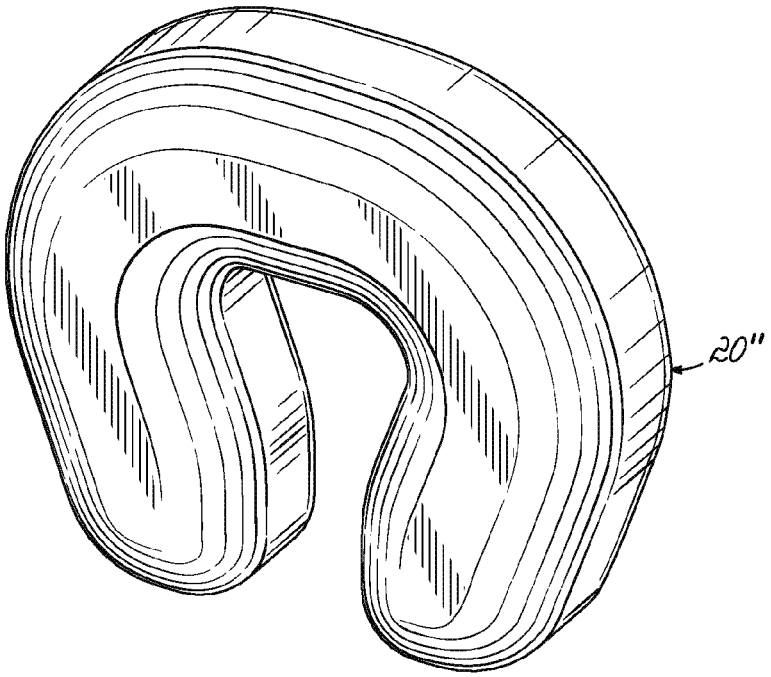
FIG. 8A is a front perspective view of still another size and shape headrest.
Figure 8B:
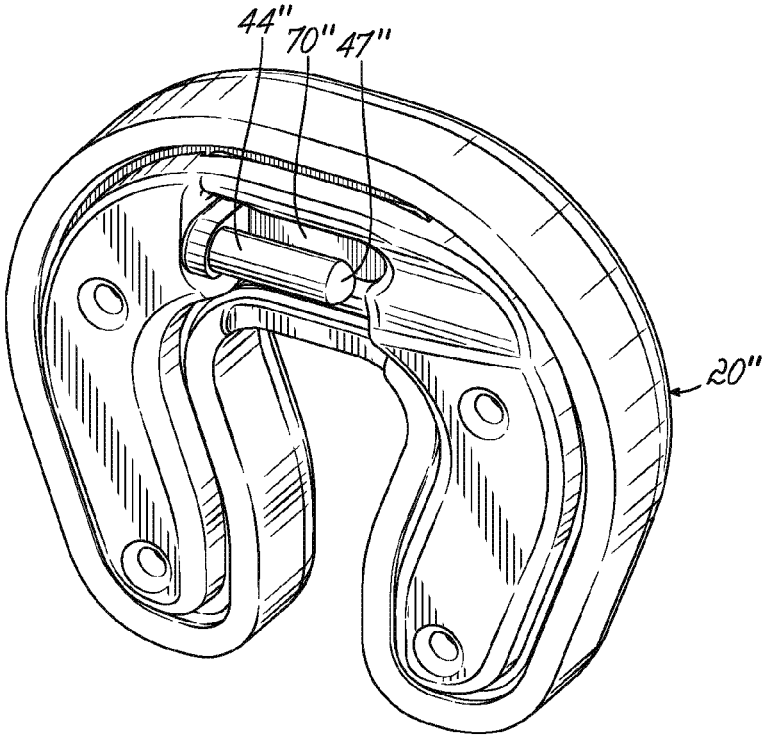
FIG. 8B is a rear perspective view of the headrest of FIG. 8A.

It will also be noted that the headrests are provided with a recess, as best seen at 70 in FIGS. 4 and 5, 70' in FIGS. 7B and 7C and 70" in FIG. 8B. During adjustment of the headrests about the two axes, the connector 36 may be seated in the recess, as shown in FIG. 7C, to prevent the headrests from being inadvertently removed axially.

While the present invention has been illustrated by the description of one or more exemplary embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed:

1. In a procedure chair including a headrest and a back section, the improvement comprising:

a pintle fixed adjacent one end thereof to said headrest and cantilevered in spaced relation thereto;

a connector interconnecting said back section and said headrest;

said connector having a socket freely receiving said pintle for movement of said pintle axially thereof into and out of said socket to permit an exchange of headrests; and a clamp for selectively clamping said pintle in said socket to thereby connect said headrest rigidly to said back section;

wherein said back section includes a crossbar, and said connector has a second socket freely receiving said crossbar; and wherein:

said clamp includes opposing, substantially C-shaped resilient sections, and said pintle and said crossbar are received therein.

2. The chair of claim 1 wherein:

said clamp has medially thereof a threaded socket, and a complementarily threaded shaft has an end thereof received in said threaded socket.

3. The chair of claim 2 further comprising:

a knob fixed to an opposite end of said shaft, whereby twisting said knob causes clamping and unclamping of said clamp simultaneously about both said pintle and said crossbar.

4. In a procedure chair including a headrest and a back section, the improvement comprising:

a pintle fixed adjacent one end thereof to said headrest and cantilevered in spaced relation thereto;

a connector interconnecting said back section and said headrest;

said connector having a socket freely receiving said pintle for movement of said pintle axially thereof into and out of said socket to permit an exchange of headrests; and a clamp for selectively clamping said pintle in said socket to thereby connect said headrest rigidly to said back section;

wherein:

said headrest has a padded upper surface and a lower surface to which said pintle is fixed, and said lower surface has a recess therein to receive said connector and prevent inadvertent axial removal of headrests.

5. A procedure chair comprising:

a plurality of sections interconnected to define a longitudinally-extending patient supporting surface, said sections including a headrest having a padded upper surface and a lower surface and a back section, a pintle secured adjacent one end thereof to said lower surface of said headrest, cantilevered over said lower surface of said headrest, and terminating in a free end, a connector having first and second sockets, said free end of said pintle being freely insertable into said first socket to permit selective attachment and removal of said headrest and thereby allow an exchange of headrests, a pair of parallel posts attached to and extending substantially parallel from said back section and having distal ends, a crossbar fixed to said distal ends of said posts and extending substantially normal thereto, said crossbar being received in said second socket, a clamp for selectively, simultaneously clamping and unclamping said pintle and crossbar in said first and second sockets to thereby alternatively fix or release said headrest with respect to said back section and permit said headrest to be adjusted with respect to said back section or removed therefrom to exchange headrests, said clamp including opposing, substantially C-shaped resilient sections with said pintle and crossbar received therein, a threaded socket positioned medially of said clamp, a complementarily threaded shaft having one end thereof received in said threaded socket, and a knob fixed to an opposite end of said shaft, whereby twisting said knob causes said clamping and unclamping of said clamp simultaneously about said pintle and crossbar.

* * * * *